US010660390B2

(12) United States Patent
Ku

(10) Patent No.: US 10,660,390 B2
(45) Date of Patent: May 26, 2020

(54) SAFETY HELMET WITH ROTARY IMPACT BUFFERING FUNCTION

(71) Applicant: Cheng-Huei Ku, Zhejiang (CN)

(72) Inventor: Cheng-Huei Ku, Zhejiang (CN)

( * ) Notice: Subject to any disclaimer, the term of this patent is extended or adjusted under 35 U.S.C. 154(b) by 153 days.

(21) Appl. No.: 15/933,404

(22) Filed: Mar. 23, 2018

(65) Prior Publication Data

US 2018/0271198 A1 Sep. 27, 2018

(30) Foreign Application Priority Data

| | | |
|---|---|---|
| Mar. 27, 2017 | (CN) | 2017 2 0306130 U |
| Apr. 18, 2017 | (CN) | 2017 2 0409239 U |
| Aug. 14, 2017 | (CN) | 2017 1 0693725 |
| Mar. 14, 2018 | (CN) | 2018 1 0210306 |

(51) Int. Cl.
*A42B 3/06* (2006.01)
*A42B 3/14* (2006.01)

(52) U.S. Cl.
CPC ..... *A42B 3/064* (2013.01); *A42B 3/063* (2013.01); *A42B 3/14* (2013.01); *A42B 3/142* (2013.01); *A42B 3/145* (2013.01); *A42B 3/147* (2013.01); *Y10T 24/45105* (2015.01)

(58) Field of Classification Search
CPC ..... A42B 3/064; A42B 3/14; A42B 3/145; A42B 3/063; A42B 3/142; A42B 3/147; Y10T 24/45105
See application file for complete search history.

(56) References Cited

U.S. PATENT DOCUMENTS

| | | | | |
|---|---|---|---|---|
| 2,585,937 A * | 2/1952 | Johnson | A42B 3/14 2/182.5 |
| 6,718,559 B1 * | 4/2004 | Davidson | A42B 3/0406 2/209.13 |
| 9,750,297 B1 * | 9/2017 | Mini Townson | A42B 3/14 |
| 2011/0041299 A1 * | 2/2011 | Onuma | B60R 13/0206 24/662 |

(Continued)

FOREIGN PATENT DOCUMENTS

| | | |
|---|---|---|
| CN | 101467799 | 7/2009 |
| CN | 103228163 | 8/2015 |

(Continued)

OTHER PUBLICATIONS

"Office Action of Taiwan Counterpart Application", dated Sep. 10, 2018, p. 1-p. 7.

*Primary Examiner* — Khaled Annis
(74) *Attorney, Agent, or Firm* — JCIPRNET

(57) ABSTRACT

A safety helmet with a rotary impact buffering function comprises a shell and an elastic liner arranged in the shell, wherein a gap is formed between the shell and the elastic liner, and a rotary impact buffering device enabling the shell to rotate relative to the elastic liner is arranged between the shell and the elastic liner. When the safety helmet is impacted by external force, the shell has the tendency to rotate relative to the elastic liner under the effect of component force applied to the shell in the tangential direction; however, through tangential deformation of the rotary impact buffering device, the shell can rotate relative to the elastic liner by a certain angle on the premise of keeping the elastic liner unmoved, and thus the impact to users from external force is greatly reduced.

9 Claims, 4 Drawing Sheets

(56) References Cited

U.S. PATENT DOCUMENTS

| | | | | |
|---|---|---|---|---|
| 2012/0198604 | A1* | 8/2012 | Weber | A42B 3/125 2/414 |
| 2014/0090156 | A1* | 4/2014 | Tom | A42B 3/0473 2/421 |
| 2016/0161222 | A1* | 6/2016 | Lee | A42B 3/065 |
| 2016/0316847 | A1* | 11/2016 | Weber | A42B 3/125 |
| 2017/0013907 | A1* | 1/2017 | Salmini | A42B 3/14 |
| 2017/0105470 | A1* | 4/2017 | Eaton | A42B 3/064 |
| 2017/0172242 | A1* | 6/2017 | Leatt | A42B 3/127 |
| 2017/0290389 | A1* | 10/2017 | Copeland | A42B 3/0406 |

FOREIGN PATENT DOCUMENTS

| | | |
|---|---|---|
| CN | 204796822 | 11/2015 |
| CN | 102905570 | 3/2016 |

* cited by examiner

SAFETY HELMET WITH ROTARY IMPACT BUFFERING FUNCTION

CROSS REFERENCE TO RELATED APPLICATION

This application claims the priority benefit of China application serial no. 2017106937257, filed on Aug. 14, 2017, China application serial no. 2017204092393, filed on Apr. 18, 2017, China application serial no. 2017203061307, filed on Mar. 27, 2017, and China application serial no. 201810210306.8, filed on Mar. 14, 2018. The entirety of each of the above-mentioned patent applications is hereby incorporated by reference herein and made a part of this specification.

BACKGROUND OF THE INVENTION

1. Field of the Invention

The invention relates to the field of safety protection, in particular to a safety helmet with a rotary impact buffering function.

2. Description of Related Art

Safety helmets are common safety protection articles; the utility model with the Chinese patent application No. CN201520252101.8 discloses a safety helmet which comprises a safety helmet shell, a safety helmet liner, a fixing endpoint, helmet ribbons, a fixing buckle and a fixing ring, wherein the safety helmet liner made of an elastic material is fixed in the safety helmet shell through an outer ring buckle, the fixing endpoint is arranged at the top end, close to the safety helmet shell, of the safety helmet liner, and the fixing buckle is arranged at the top end in the safety helmet shell. Traditional safety helmets are mainly used for protecting the heads of users against normal impact on the safety helmets from the outside; however, actually, when accidents happen, the probability that the safety helmets purely bear normal impact force is low, on most occasions, besides the normal impact force, tangential impact force is also applied to the safety helmets, the safety helmets are likely to rotate by a certain angle under the effect of the tangential impact force, and consequentially the heads of users are prone to being bruised. On this account, a safety helmet with a rotary impact buffering function, which can well buffer external rotary impact force and protect the heads of users against bruises when suffering from the rotary impact of external force, is urgently to be provided.

BRIEF SUMMARY OF THE INVENTION

To overcome the defects that existing safety helmets are poor in capacity to bear the rotary impact of external force and cannot effectively protect the heads of users against bruises when suffering from the rotary impact of external force, the invention provides a safety helmet with a rotary impact buffering function, which can well buffer external rotary impact force and effectively protect the heads of users against bruises when suffering from the rotary impact of external force.

According to the specific technical scheme of the invention, a safety helmet with a rotary impact buffering function comprises a shell and an elastic liner arranged in the shell, wherein a gap is formed between the shell and the elastic liner, and a rotary impact buffering device enabling the shell to rotate relative to the elastic liner is arranged between the shell and the elastic liner. In the invention, the rotary impact buffering device is arranged between the shell and the elastic liner of the safety helmet and is capable of elastically deforming in the normal direction of the safety helmet and also capable of elastically deforming in the tangential direction of the safety helmet. When the safety helmet is impacted by external force, the shell has the tendency to rotate relative to the elastic liner under the effect of the component force applied to the shell in the tangential direction; however, in the invention, the rotary impact buffering device enabling the shell to rotate relative to the elastic liner is arranged between the shell and the elastic liner, through tangential deformation of the rotary impact buffering device, the shell can rotate relative to the elastic liner by a certain angle on the premise of keeping the elastic liner unmoved relatively, so that a rotary impact buffering function is achieved, and impact to users from external force is greatly reduced. In addition, the rotary impact buffering device deforms within a certain range, after the shell of the safety helmet rotates relative to the elastic liner by a certain angle, the anti-rotation damping force of the rotary impact buffering device is increased greatly, and thus the rotation angle of the shell relative to the elastic liner is controlled within a certain range. In this way, the defects that existing safety helmets are poor in capacity to bear the rotary impact of external force and cannot effectively protect heads against bruises when suffering from the rotary impact of external force are overcome, and the protection effect of the safety helmet on users is greatly improved.

Preferably, the rotary impact buffering device comprises a plurality of buffering components. Each buffering component comprises a plastic nail holder, a columnar elastic washer and a plastic nail, wherein the plastic nail holder is inlaid in the inner side of the shell and provided with an outer step hole with the small-diameter end located at the inner end, the elastic washer is provided with an inner step hole with the small-diameter end located at the outer end, the outer end face of the elastic washer is tightly attached to the inner end face of the plastic nail holder, and the elastic washer and the plastic nail holder are connected through the plastic nail; each plastic nail comprises a platen, a nail rod and an anti-disengaging buckle head, wherein the platen is located in the large-diameter section of the corresponding inner step hole, the nail rod penetrates through the small-diameter section of the corresponding inner step hole and the small-diameter section of the corresponding outer step hole, one end of the nail rod is connected with the platen, the diameter of the small-diameter section of the corresponding inner step hole is matched with the outer diameter of the nail rod, and the diameter of the small-diameter section of the corresponding outer step hole is greater than the outer diameter of the nail rod, the anti-disengaging buckle head is located in the large-diameter section of the corresponding outer step hole and connected with the other end of the nail rod, and the inner end face of the elastic washer is connected with the elastic liner. The safety helmet is structurally provided with the plastic nail holders connected with the shell and the elastic washers connected with the elastic liner, the plastic nail holders and the elastic washers are connected through the plastic nails, and the plastic nails are fixed relative to the elastic washers. As the outer diameter of the nail rods of the plastic nails is far smaller than the diameter of the small-diameter sections of the outer step holes, the plastic nail holders and the elastic washers can transversely slide within a certain range, part of the buffering displacement for the shell to rotate relative to the elastic liner is formed accordingly, the anti-disengagement buckle heads are used for preventing the nail rods from disengaging from the plastic nail holders, and thus connection between the plastic nail holders and the elastic washers is ensured. In the description, the inner end refers to the end close to the elastic liner, and the outer end refers to the end, close to the shell, of the rotary impact buffering device. Furthermore, the elastic washers can compressively deform in the longitudinal direction or the transverse direction when being impacted by external force, the compressive deformation in the longitudinal direction can buffer impact in the normal direction of the safety helmet, and the compressive deformation in the transverse direction forms the other part of the buffering displacement for the shell to rotate relative to the elastic liner. In this way, the plastic nail holders, the plastic nails and the elastic washers of the buffering components are matched with the elastic liner to achieve multi-buffering protection of normal impact force and rotary (tangential) impact force, and thus a better protection effect is achieved. The elastic washers are connected with the plastic nail holders inlaid in the inner side of the shell through the plastic nails, and thus assembling and disassembling are convenient and fast.

Preferably, an inner convex ring and an outer convex ring are separately arranged on the outer peripheries of the two ends of each elastic washer, the elastic washers are connected with the elastic liner through the inner convex rings, a plurality of outer circular grooves are formed in the outer periphery of each elastic washer between the corresponding inner convex ring and the corresponding outer convex ring, and a plurality of inner circular grooves are formed in the inner periphery of the large-diameter section of the inner step hole of each elastic washer. The effective contact areas between the elastic washers and the plastic nail holders and the effective contact areas between the elastic washers and the elastic liner can be effectively increased through the inner convex rings and the outer convex rings, and the structural stability of the buffering components under the effect of tangential force is improved; and under the combined effect of the inner circular grooves and the outer circular grooves, the side walls of the elastic washers are each of a corrugated structure, and thus the buffering performance of the buffering components is improved.

Preferably, the contact surface between each platen and the corresponding elastic washer is of a concave spherical structure, and the inner end face of each elastic washer is of a convex spherical structure. The platens are matched with the elastic washers through spherical contact, and the elastic washers are matched with the elastic liner through spherical contact, so that the structural stability of the buffering components under the effect of tangential force is improved, and the buffering performance of the buffering components is improved.

As another optional scheme, the rotary impact buffering device comprises a plurality of buffering assemblies. Each buffering assembly comprises a mounting plate and buffering columns, wherein the mounting plate is provided with a plurality of columnar buffering washers and connected with the inner side of the shell, the mounting plate is also provided with mounting holes, the number of mounting holes is the same as that of the buffering washers, and the buffering washers are arranged in the mounting holes in a one-to-one corresponding mode; the number of the buffering columns is the same as that of the buffering washers, and the buffering columns are embedded in inner holes of the buffering washers in a one-to-one corresponding mode; and the length of the buffering columns is smaller than the depth of the inner holes of the buffering washers, the height of the buffering washers is greater than the thickness of the mounting plate, and the inner ends of the buffering washers is connected with the elastic liner. When the safety helmet of this structure is impacted by external force, the buffering washers and the buffering columns of the buffering assemblies are matched with the elastic liner to achieve multi-buffering protection against normal impact force and rotary (tangential) impact force, and thus the buffering effect is good. The mounting plate of each buffering assembly is provided with a plurality of buffering washers connected with the inner side of the shell, the buffering columns are inlaid in the inner holes of the buffering washers, in this way, buffering protection is achieved through elastic deformation of the buffering washers, the elastic deformation of the buffering washers is controlled within a certain range, and thus the buffering washers can restore easily.

Preferably, a plurality of outer circular grooves are formed in the outer periphery of each buffering washer, a plurality of inner grooves are formed in the inner periphery of each buffering washer, the outer grooves and the inner grooves are arranged in a staggered mode in the axis direction of each buffering washer. Under the combined effect of the outer grooves and the inner grooves, the side walls of the buffering washers are each of a corrugated structure, and thus the buffering performance of the buffering washers is improved.

Preferably, counter bores are formed in the inner side of the shell, the number of the counter bores is the same as that of the buffering washers, and the counter bores are in one-to-one correspondence with the buffering washers; outer flanges which are matched with the counter bores are arranged at the outer ends of the buffering washers, inner flanges are arranged at the inner ends of the buffering washers, and the buffering washers are connected with the elastic liner through the inner flanges. The connection strength of the buffering washers and the shell can be improved through the outer flanges of the buffering washers, and the connection strength of the buffering washers and the head lock, as well as between the buffering washers and the elastic liner, can be improved through the inner flanges of the buffering washers.

As another optional scheme, the rotary impact buffering device comprises a notch, a plurality of elastic supporting columns and a buffering pad, wherein the notch is formed in the inner side of the shell, the outer ends of the elastic supporting columns are connected with the bottom surface of the notch, the buffering pad is provided with positioning holes, the number of the positioning holes is the same as that of the elastic supporting columns, the buffering pad is arranged in the notch, the outer ends of the elastic supporting columns are sleeved with the positioning holes in a one-to-one corresponding mode, and the inner ends of the elastic supporting columns are connected with the elastic liner. Through the structure, when the safety helmet suffers from the rotary impact of external force, the elastic supporting columns and the buffering pad of the buffering assembly are matched with the elastic liner to achieve multi-buffering protection against impact force and rotary impact force, and the elastic supporting columns can restore easily through the buffering pad.

Preferably, the safety helmet with a rotary impact buffering function further comprises U-shaped buffering strips, wherein one end of each U-shaped buffering strip is connected with the elastic liner, the other end of each U-shaped buffering strip is connected with one end of a connecting strip, and a buckle head is arranged at the other end of each connecting strip, buckle holes matched with the buckle heads are formed in the inner side of the shell, and the buckle heads are correspondingly clamped in the buckle holes. The elastic liner is integrally connected with the shell through the U-shaped buffering strips and the connecting strips, on the one hand, the U-shaped buffering strips can form a buffering structure between the elastic liner and the shell, so that a buffering function is achieved when the safety helmet suffers from tangential force, and the buffering effect is further improved when the safety helmet is impacted by rotary force; and on the other hand, excessive sliding between the elastic liner and the shell can be limited. The buckle heads are matched with the buckle holes to achieve fixation, and thus disassembling and assembling are convenient.

Preferably, the elastic liner is of a multi-band structure and comprises a U-shaped liner band located on the head and an annular liner band surrounding the periphery of the head; the number of the U-shaped buffering strips is two, and the two U-shaped buffering strips are separately arranged on the annular liner band located on the left side and the right side of the rear portion of the safety helmet; and two binding strips are further correspondingly arranged at the joints of the U-shaped buffering strips and the elastic liner, and the other ends of the binding strips are connected with a head lock.

In the invention, the U-shaped buffering strips are arranged on the left side and the right side of the rear portion of the safety helmet, the joints of the U-shaped buffering strips and the elastic liner are located at the same positions with the joints of the binding strips and the elastic liner, the head lock is used for adjusting the tightness of the binding strips, and through the proper tightness between the binding strips and the head, the head can be protected when the safety helmet suffers from rotary impact of external force.

The safety helmet of this invention has beneficial effects. The rotary impact buffering device is arranged between the shell and the elastic liner of the safety helmet of this invention so that tangential component force generated when the safety helmet is impacted by external force can be greatly reduced, and impact to users from external force is greatly reduced. Furthermore, deformation of the rotary impact buffering device is in a set range, so that when the shell of the safety helmet rotates relative to the elastic liner by a certain angle, the anti-rotation damping force of the rotary impact buffering device is greatly increased, and thus the rotation angle of the shell relative to the elastic liner is controlled within a certain range. In this way, the defects that existing safety helmets are poor in capacity to bear the rotary impact of external force and cannot effectively protect the head against bruises when suffering from the rotary impact of external force are overcome, and the protection effect of the safety helmet on users is greatly improved.

In the FIGS.: 1, shell; 2, elastic liner; 3, binding strip; 4, head lock; 5, buffering assembly; 6, buffering washer; 7, double-faced adhesive tape; 8, mounting plate; 9, buffering column; 10, mounting hole; 11, outer groove; 12, inner groove; 13, counter bore; 14, outer flange; 15, inner flange; 16, buffering component; 17, outer step hole; 18, plastic nail holder; 19, plastic nail; 20, inner step hole; 21, elastic washer, 22, platen; 23, nail rod; 24, anti-disengaging buckle head; 25, inner convex ring; 26, outer convex ring; 27, outer circular groove; 28, inner circular groove; 29, notch; 30, elastic supporting column; 31, positioning hole; 32, buffering pad; 33, U-shaped buffering strip; 34, buckle head; 35, connecting strip; 36, buckle hole; 37, U-shaped liner band; 38, annular liner band.

DETAILED DESCRIPTION OF THE INVENTION

A further description of the invention is given with accompanying drawings as follows.

First Embodiment

Figure 1:
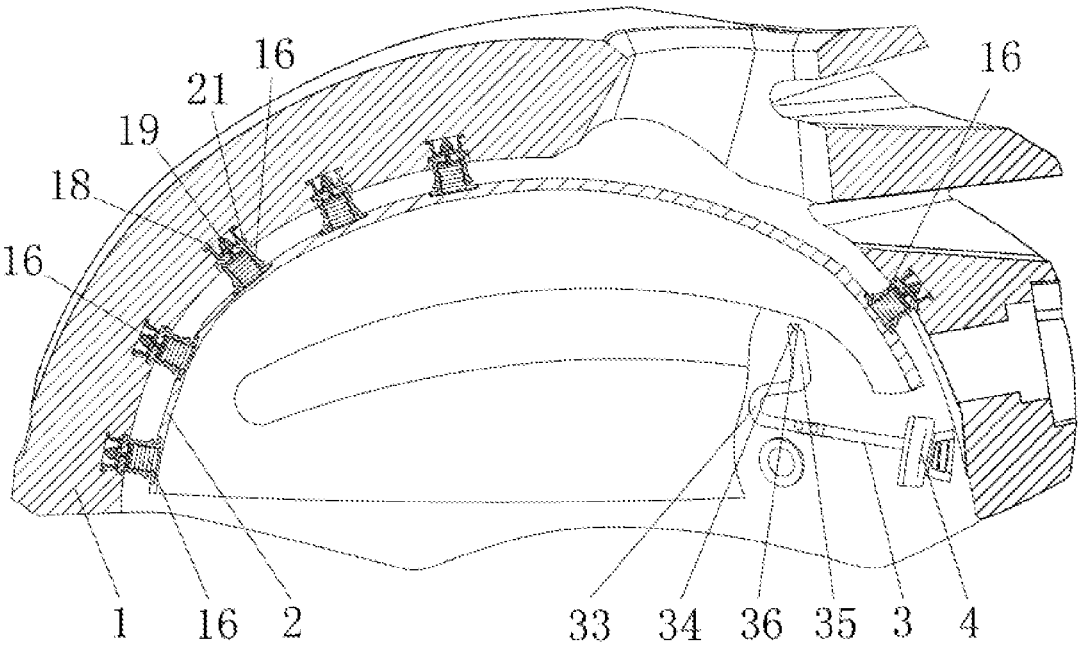
FIG. 1 is a structural sectional view of the first embodiment of the invention.
Figure 2:
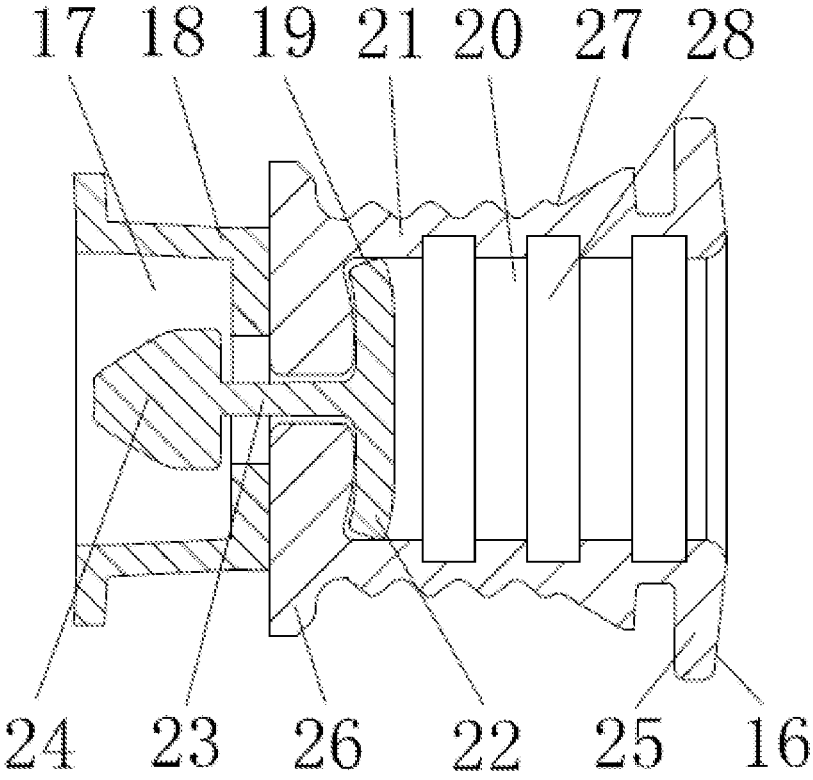
FIG. 2 is a structural sectional view of a buffering component in the first embodiment of the invention.

As is shown in FIG. 1 and FIG. 2, in the first embodiment of the invention, a safety helmet with a rotary impact buffering function comprises a shell 1 and an elastic liner 2 arranged in the shell, and the elastic liner is made of a PC board or foam. A gap is formed between the shell and the elastic liner, and a rotary impact buffering device enabling the shell to rotate relative to the elastic liner is arranged between the shell and the elastic liner. The rotary impact buffering device comprises twenty-one buffering components 16. Each buffering component comprises a plastic nail holder 18, a columnar elastic washer 21 and a plastic nail 19, wherein the plastic nail holder is inlaid in the inner side of the shell and provided with an outer step hole 17 with the small-diameter end located at the inner end, the elastic washer is provided with an inner step hole 20 with the small-diameter end located at the outer end, the outer end face of the elastic washer is tightly attached to the inner end face of the plastic nail holder, and the elastic washer and the plastic nail holder are connected through the plastic nail. Each plastic nail comprises a platen 22, a nail rod 23 and an anti-disengaging buckle head 24, wherein the platen is located in the large-diameter section of the corresponding inner step hole, the contact surface between the platen and the elastic washer is of a concave spherical structure, the nail rod penetrates through the small-diameter section of the corresponding inner step hole and the small-diameter section of the corresponding outer step hole, one end of the nail rod is connected with the platen, the diameter of the small-diameter section of the corresponding inner step hole is matched with the outer diameter of the nail rod, and the diameter of the small-diameter section of the corresponding outer step hole is greater than the outer diameter of the nail rod, and the anti-disengaging buckle head is located in the large-diameter section of the corresponding outer step hole and connected with the other end of the nail rod. In the invention, the platen, the nail rod and the anti-disengaging buckle head of each plastic nail are formed integrally, and the elastic washers are made of silica gel. The inner end face of each elastic washer is of a convex spherical structure, and the inner end face of each elastic washer is bonded with the elastic liner. An inner convex ring 25 and an outer convex ring 26 are separately arranged on the outer peripheries of the two ends of each elastic washer, and the elastic washers are bonded with the elastic liner through the inner convex rings. Six outer circular grooves 27 are formed in the outer periphery of each elastic washer between the corresponding inner convex ring and the corresponding outer convex ring, and three inner circular grooves 28 are formed in the inner periphery of the large-diameter section of the inner step hole of each elastic washer.

Figure 6:
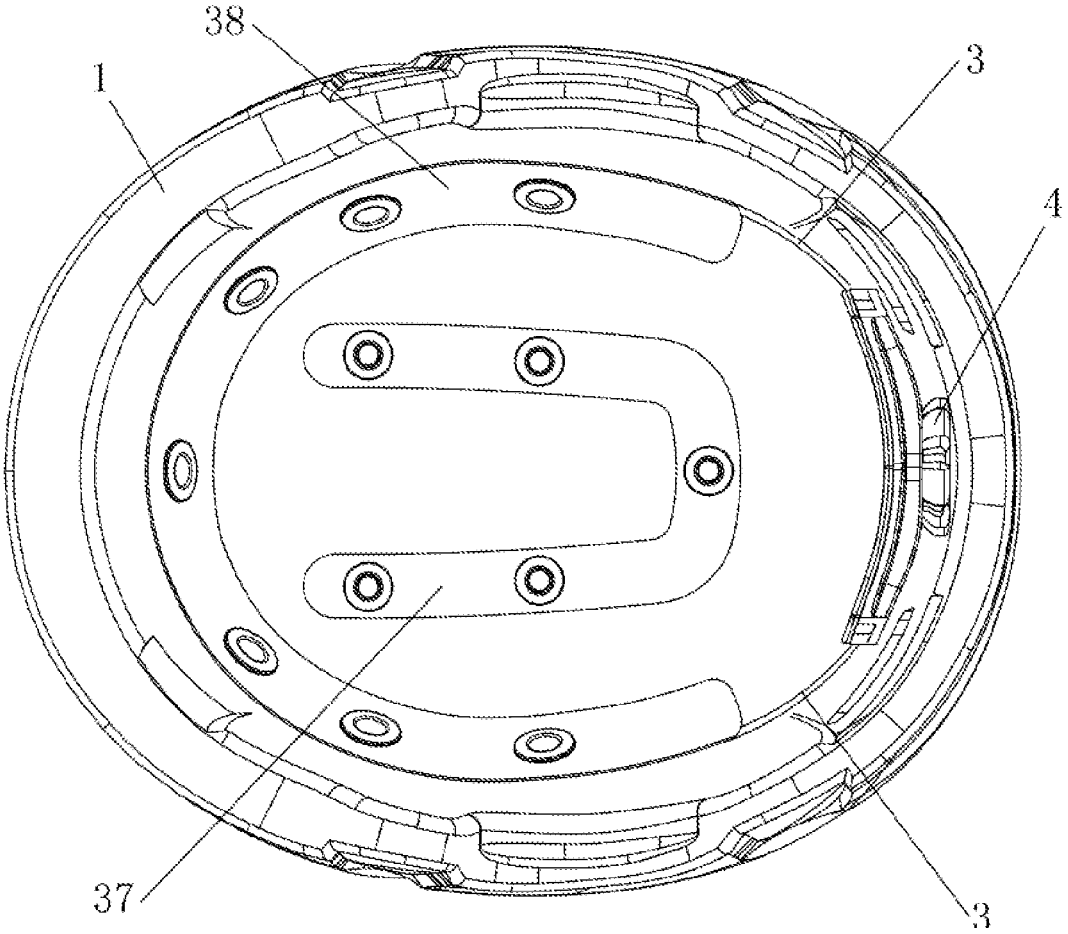
FIG. 6 is a structural bottom view of the invention.

The safety helmet with a rotary impact buffering function further comprises U-shaped buffering strips 33, wherein one end of each U-shaped buffering strip is connected with the elastic liner, the other end of each U-shaped buffering strip is integrally connected with one end of a connecting strip 35, a buckle head 34 is arranged at the other end of each connecting strip, buckle holes 36 matched with the buckle heads are formed in the inner side of the shell, and the buckle heads are correspondingly clamped in the buckle holes. In the embodiment, the elastic liner is of a two-band structure and comprises a U-shaped liner band 37 located on the head and an annular liner band 38 (as is shown in FIG. 6) surrounding the periphery of the head; the number of the U-shaped buffering strips is two, and the two U-shaped buffering strips are separately arranged on the annular liner band located on the left side and the right side of the rear portion of the safety helmet; and two binding strips 3 are further correspondingly arranged at the joints of the U-shaped buffering strips and the elastic liner, and the other ends of the binding strips are connected with a head lock 4.

Second Embodiment

Figure 3:
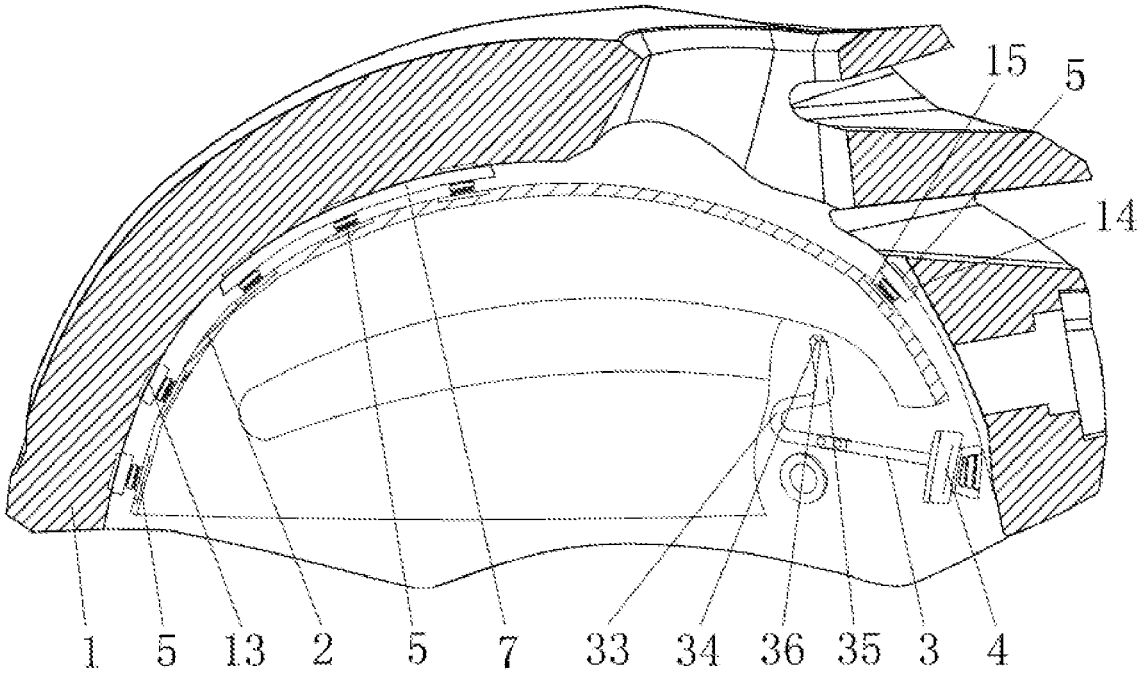
FIG. 3 is a structural sectional view of the second embodiment of the invention.
Figure 4:
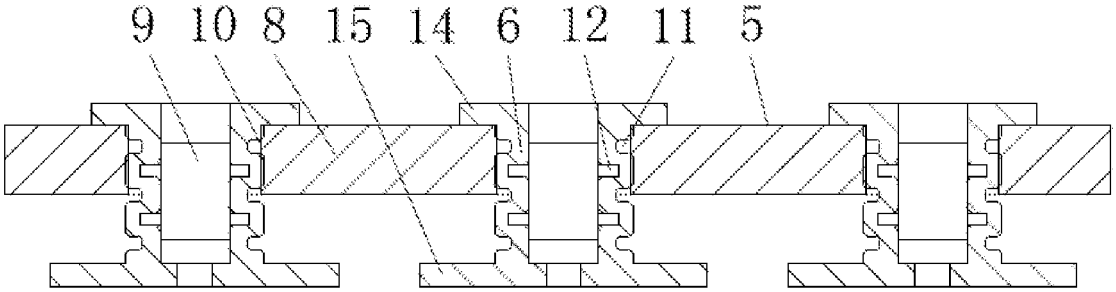
FIG. 4 is a structural sectional view of a buffering assembly in the second embodiment of the invention.

As is shown in FIG. 3 and FIG. 4, in the second embodiment of the invention, the rotary impact buffering device comprises seven buffering assemblies 5. Each buffering assembly comprises a mounting plate 8 and buffering columns 9, wherein the mounting plate 8 is provided with three columnar buffering washers 6 and connected with the inner side of the shell through double-faced adhesive tape 7, the mounting plate is also provided with mounting holes 10, the number of mounting holes is the same as that of the buffering washers 6, and the buffering washers are arranged in the mounting holes in a one-to-one corresponding mode; the number of the buffering columns is the same as that of the buffering washers, and the buffering columns are embedded in inner holes of the buffering washers in a one-to-one corresponding mode; the buffering washers and the buffering columns are made of silica gel, the length of the buffering columns is smaller than the depth of the inner holes of the buffering washers, the height of the buffering washers is greater than the thickness of the mounting plate, and the inner ends of the buffering washers are bonded with the elastic liner. Three outer grooves 11 are formed in the outer periphery of each buffering washer, two inner grooves 12 are formed in the periphery of the inner hole side of each buffering washer, and the outer grooves and the inner grooves are arranged in a staggered mode in the axis direction of each buffering washer. Counter bores 13 are formed in the inner side of the shell, the number of the counter bores is the same as that of the buffering washers, and the counter bores are in one-to-one correspondence with the buffering washers. Outer flanges 14 which are matched with the counter bores are arranged at the outer ends of the buffering washers, inner flanges 15 are arranged at the inner ends of the buffering washers, and the buffering washers are bonded with the elastic liner through the inner flanges. The second embodiment is the same as the first embodiment in other aspects.

Third Embodiment

Figure 5:
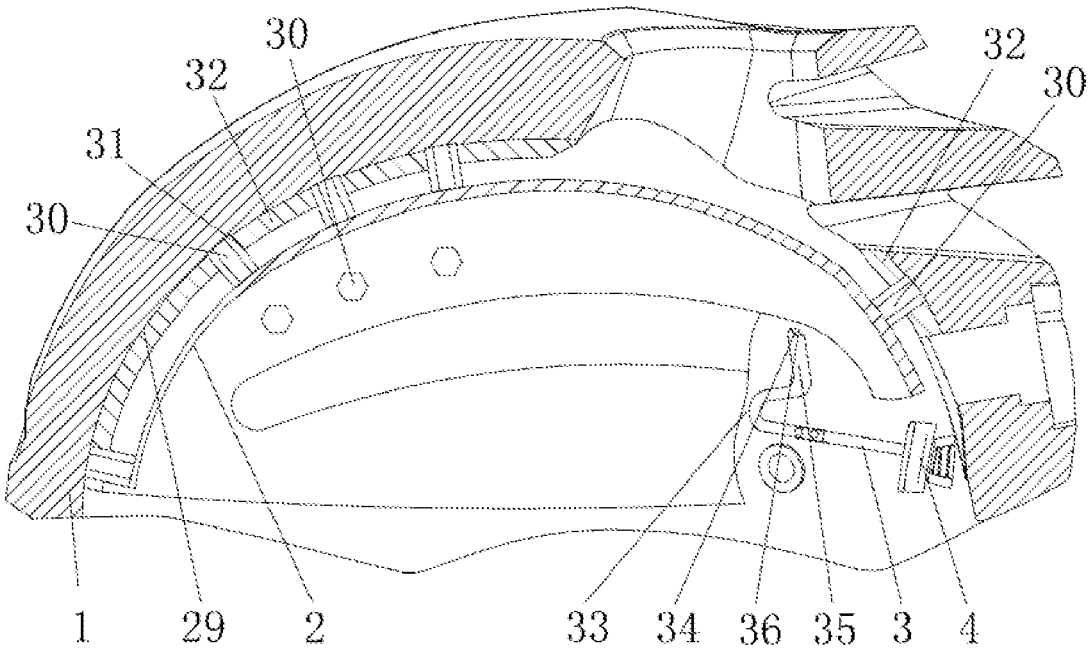
FIG. 5 is a structural sectional view of the third embodiment of the invention.

As is shown in FIG. 5, in the third embodiment of the invention, the rotary impact buffering device comprises a notch 29, twenty-four elastic supporting columns 30 and a buffering pad 32, wherein the notch is formed in the inner side of the shell, the outer ends of the twenty-four elastic supporting columns are connected with the bottom surface of the notch, the buffering pad is provided with positioning holes 31, and the number of the positioning holes is the same as that of the elastic supporting columns; and the buffering pad is arranged in the notch, the outer ends of the elastic supporting columns are sleeved with the positioning holes in a one-to-one corresponding mode, and the inner ends of the elastic supporting columns are bonded with the elastic liner. In the embodiment, the elastic supporting columns are made of nylon, the cross section of the elastic supporting columns is in a regular hexagon shape, and the buffering pad 32 is made of silica gel. The third embodiment is the same as the first embodiment in other aspects.

Tests show that compared with traditional safety helmets, the safety helmet with a rotary impact buffering function in the three embodiments of the invention has the following advantages:

under the conditions that the falling height is 1 m, the falling speed is 4.43 m/s and the rotational accelerations at test points are 4065(r/s2), 5527 (r/s2) and 6548 (r/s2) separately, damage to the safety helmet with a rotary impact buffering function in the three embodiments is reduced by 26.4-45.7%;

under the conditions that the falling height is 1.5 m, the falling speed is 5.42 m/s and the rotational accelerations at test points are 5683(r/s2), 6294 (r/s2) and 7094 (r/s2) separately, damage to the safety helmet with a rotary impact buffering function in the three embodiments is reduced by 33.1-32.3%.

According to the safety helmet of the invention, the rotary impact buffering device is arranged between the shell and the elastic liner and is capable of elastically deforming in the normal direction of the safety helmet and also capable of elastically deforming in the tangential direction of the safety helmet. When the safety helmet is impacted by external force, the shell has the tendency to rotate relative to the elastic liner under the effect of the component force applied to the shell in the tangential direction; however, the rotary impact buffering device enabling the shell to rotate relative to the elastic liner is arranged between the shell and the elastic liner of the invention, through tangential deformation of the rotary impact buffering device, the shell can rotate relative to the elastic liner by a certain angle on the premise of keeping the elastic liner unmoved relatively, so that a rotary impact buffering function is achieved, and the impact to users from external force is greatly reduced. In addition, the rotary impact buffering device deforms within a certain range, after the shell of the safety helmet rotates relative to the elastic liner by a certain angle, the anti-rotation damping force of the rotary impact buffering device is increased greatly, and thus the rotation angle of the shell relative to the elastic liner is controlled within a certain range. Furthermore, the elastic liner is integrally connected with the shell through the U-shaped buffering strips and the connecting strips, and thus the buffering effect is further improved when the safety helmet is impacted by rotary force. In this way, the defects that existing safety helmets are poor in capacity to bear the rotary impact of external force and cannot effectively protected the heads of users against bruises when suffering from the rotary impact of external force are overcome, and the protection effect of the safety helmet on users is greatly improved.

Besides the above embodiments, those skilled in the field can create novel embodiments by reselecting and recombining the technical characteristics or technical data of the invention within the scope defined by the claims and the description of the invention without creative work, and all these embodiments not described in detail in the description are also regarded as specific embodiments of the invention and are also within the protection scope of the invention.

What is claimed is:

1. A safety helmet with a rotary impact buffering function, comprising:

a shell, comprising an elastic liner arranged in the shell, wherein a gap is formed between the shell and the elastic liner; and a rotary impact buffering device, enabling the shell to rotate relative to the elastic liner and arranged between the shell and the elastic liner, wherein the rotary impact buffering device comprises a plurality of buffering components; each buffering component comprises:

a plastic nail holder, wherein the plastic nail holder is inlaid in an inner side of the shell and provided with an outer step hole with a small-diameter end located at an inner end of the plastic nail holder;

a columnar elastic washer, wherein the elastic washer is provided with an inner step hole with a small-diameter end located at an outer end of the elastic washer, and an outer end face of the elastic washer is tightly attached to an inner end face of the plastic nail holder; and a plastic nail, wherein the elastic washer and the plastic nail holder are connected through the plastic nail, and each plastic nail comprises:

a platen, located in a large-diameter section of the corresponding inner step hole;

a nail rod, penetrates through a small-diameter section of the corresponding inner step hole and a small-diameter section of the corresponding outer step hole, wherein one end of the nail rod is connected with the platen, a diameter of the small-diameter section of the corresponding inner step hole is matched in size with an outer diameter of the nail rod, a diameter of the corresponding small-diameter section of the outer step hole is greater than the outer diameter of the nail rod; and an anti-disengaging buckle head, located in a large-diameter section of the outer step hole and connected with other end of the nail rod, wherein an inner end face of the elastic washer is connected with the elastic liner.

2. The safety helmet with a rotary impact buffering function according to claim 1, wherein an inner convex ring and an outer convex ring are separately arranged on outer peripheries of an inner end and the outer end of each elastic washer, the elastic washers are connected with the elastic liner through the inner convex rings, a plurality of outer circular grooves are formed in an outer periphery of each elastic washer between the corresponding inner convex ring and the corresponding outer convex ring, and a plurality of inner circular grooves are formed in an inner periphery of the large-diameter section of the inner step hole of each elastic washer.

3. The safety helmet with a rotary impact buffering function according to claim 1, wherein a surface of each platen in contact with the corresponding elastic washer has a concave spherical shape, and the inner end face of each elastic washer has a convex spherical shape.

4. The safety helmet with a rotary impact buffering function according to claim 1, wherein the rotary impact buffering device comprises a plurality of buffering assemblies; each buffering assembly comprises:

a mounting plate and buffering columns, wherein the mounting plate is provided with a plurality of columnar buffering washers and connected with an inner side of the shell, the mounting plate is also provided with mounting holes, the number of mounting holes is the same as that of the buffering washers, the buffering washers are arranged in the mounting holes in a one-to-one corresponding mode, the number of the buffering columns is the same as that of the buffering washers, and the buffering columns are embedded in inner holes of the buffering washers in a one-to-one corresponding mode; and a length of the buffering columns is smaller than a depth of the inner holes of the buffering washers, a height of the buffering washers is greater than a thickness of the mounting plate, and the inner ends of the buffering washers is connected with the elastic liner.

5. The safety helmet with a rotary impact buffering function according to claim 4, wherein a plurality of outer grooves are formed in an outer periphery of each buffering washer;

a plurality of inner grooves are formed in a periphery of the inner hole of each buffering washer; and the outer grooves and the inner grooves are arranged in a staggered mode in an axis direction of each buffering washer.

6. The safety helmet with a rotary impact buffering function according to claim 4, wherein counter bores are formed in the inner side of the shell, the number of the counter bores is the same as that of the buffering washers, and the counter bores are in one-to-one correspondence with the buffering washers;

outer flanges which are matched with the counter bores are arranged at an outer ends of the buffering washers, and inner flanges are arranged at an inner ends of the buffering washers; and the buffering washers are connected with the elastic liner through the inner flanges.

7. The safety helmet with a rotary impact buffering function according to claim 1, wherein the rotary impact buffering device comprises:

a notch, formed in the inner side of the shell;

a plurality of elastic supporting columns, wherein outer ends of the elastic supporting columns are connected with a bottom surface of the notch; and a buffering pad, provided with positioning holes, wherein the number of the positioning holes is the same as that of the elastic supporting columns, the buffering pad is arranged in the notch, and the outer ends of the elastic supporting columns are sleeved with the positioning holes in a one-to-one corresponding mode, and inner ends of the elastic supporting columns are connected with the elastic liner.

8. The safety helmet with a rotary impact buffering function according to claim 1, further comprising:

U-shaped buffering strips, wherein one end of each U-shaped buffering strip is connected with the elastic liner, the other end of each U-shaped buffering strip is connected with one end of a connecting strip;

a buckle head, arranged at the other end of each connecting strip; and buckle holes, wherein the buckle holes matched with the buckle heads are formed in the inner side of the shell, and the buckle heads are correspondingly clamped in the buckle holes.

9. The safety helmet with a rotary impact buffering function according to claim 8, wherein the elastic liner is of a multi-band structure and comprises:

a U-shaped liner band located on the head; and an annular liner band surrounding the periphery of the head, wherein the number of the U-shaped buffering strips is two, and the two U-shaped buffering strips are separately arranged on the annular liner band located on a left side and a right side of the rear portion of the safety helmet; and two binding strips are further correspondingly arranged at the joints of the U-shaped buffering strips and the elastic liner, and the other ends of the binding strips are connected with a head lock.

* * * * *